United States Patent [19]

Saha

[11] Patent Number: 4,574,972

[45] Date of Patent: Mar. 11, 1986

[54] PROTECTIVE CAP FOR DIESEL FUEL FILTER

[76] Inventor: Henry L. Saha, 583 Sharonway, Bolingbrook, Ill. 60439

[21] Appl. No.: 730,004

[22] Filed: May 2, 1985

[51] Int. Cl.[4] ..... B65D 53/18

[52] U.S. Cl. ..... 220/254; 210/136; 210/184; 220/200

[58] Field of Search ..... 220/200, 254; 210/130, 210/136, 184, 186

[56] References Cited

U.S. PATENT DOCUMENTS 3,486,665 12/1969 LaCroce ..... 220/254

4,190,173 2/1980 Mason et al. ..... 220/254

*Primary Examiner*—George T. Hall

*Attorney, Agent, or Firm*—Ernest Kettelson

[57] ABSTRACT

A protective cap for a diesel fuel filter which is placed on the working end of the filter by the filter manufacturer prior to sale to prevent dirt and other contaminants from getting into filter, particulary on the downstream side of the filtering material. The diesel fuel filter comprises a canister having an open working end partially covered by a circular apertured wall in which there is a large central aperture opening to a cavity in the canister on the downstream side of the filtering material. The filtering material forms an annular ring surrounding the central cavity. A series of smaller apertures extend around the outer periphery of the apertured circular wall which receive diesel fuel during operation on the upstream side of the filtering material. The fuel then passes through the filtering material into the central cavity where it then flows to the diesel pump when the filter is mounted in place on the diesel engine. The protective cap comprises a circular disc of the same diameter as the circular apertured wall, having a plug in the center to seat in the large central aperture of the circular apertured wall to seal the downstream central cavity of the filter from entry of dirt or other contaminatns, and having a series of annularly spaced apart holes in registration with some or all of the smaller apertures around the outer periphery of the circular apertured wall to admit unfiltered diesel fuel on the upstream side of the filtering material to fill and prime a new filter prior to installing it in place on the diesel engine.

8 Claims, 4 Drawing Figures

PROTECTIVE CAP FOR DIESEL FUEL FILTER

BACKGROUND OF THE INVENTION

This invention relates to the field of fuel oil filters for diesel engines, and in particular to protective devices that keep the new filter clean between the time it is removed from the manufacturer's package and installed on the diesel engine.

When a new fuel filter is to replace an old one on a diesel engine, the new filter has to be primed by filling with diesel fuel. It is important that such priming diesel fuel, which may contain some dirt and contaminants, is poured into the filter on the up-stream side of the filtering material, and that none of it is poured into the central cavity of the filter which is on the downstream side. To accomplish this, the present invention comprises a removable cap placed over the open working end of the filter which has a plug that seats in the entrance to the central cavity of the filter to prevent any of the priming diesel fuel from getting into the central cavity on the downstream side of the filtering material. The removable cap includes a series of circumferentially spaced apart apertures which open to the filter cavity on the upstream side of the filtering material. Thus, the filter can be filled with priming diesel fuel which has to pass through the filtering material to filter out any dirt or contaminants which could otherwise reach and damage the fuel pump when the new filter is installed on the engine.

The inventor does not know of any prior art devices of this kind for use with diesel fuel filters and diesel engines. A search revealed an accessory for coffee percolators disclosed in U.S. Pat. No. 2,953,985 which prevents coffee from getting down the central stem of the percolator, a filler fixture for use in pouring explosive material into hand grenades as disclosed in U.S. Pat. No. 2,360,914, and U.S. Pat. No. 2,122,216 discloses a bulk dispensing device for measuring pulverulent household materials such as coffee.

SUMMARY OF THE INVENTION

It is an object of the invention to provide a protective cap for diesel fuel filters to prevent contaminated diesel fuel from entering the filter on the downstream side of the filtering material when being primed prior to installing on the diesel engine.

DESCRIPTION OF PREFERRED EMBODIMENT

Figure 1:
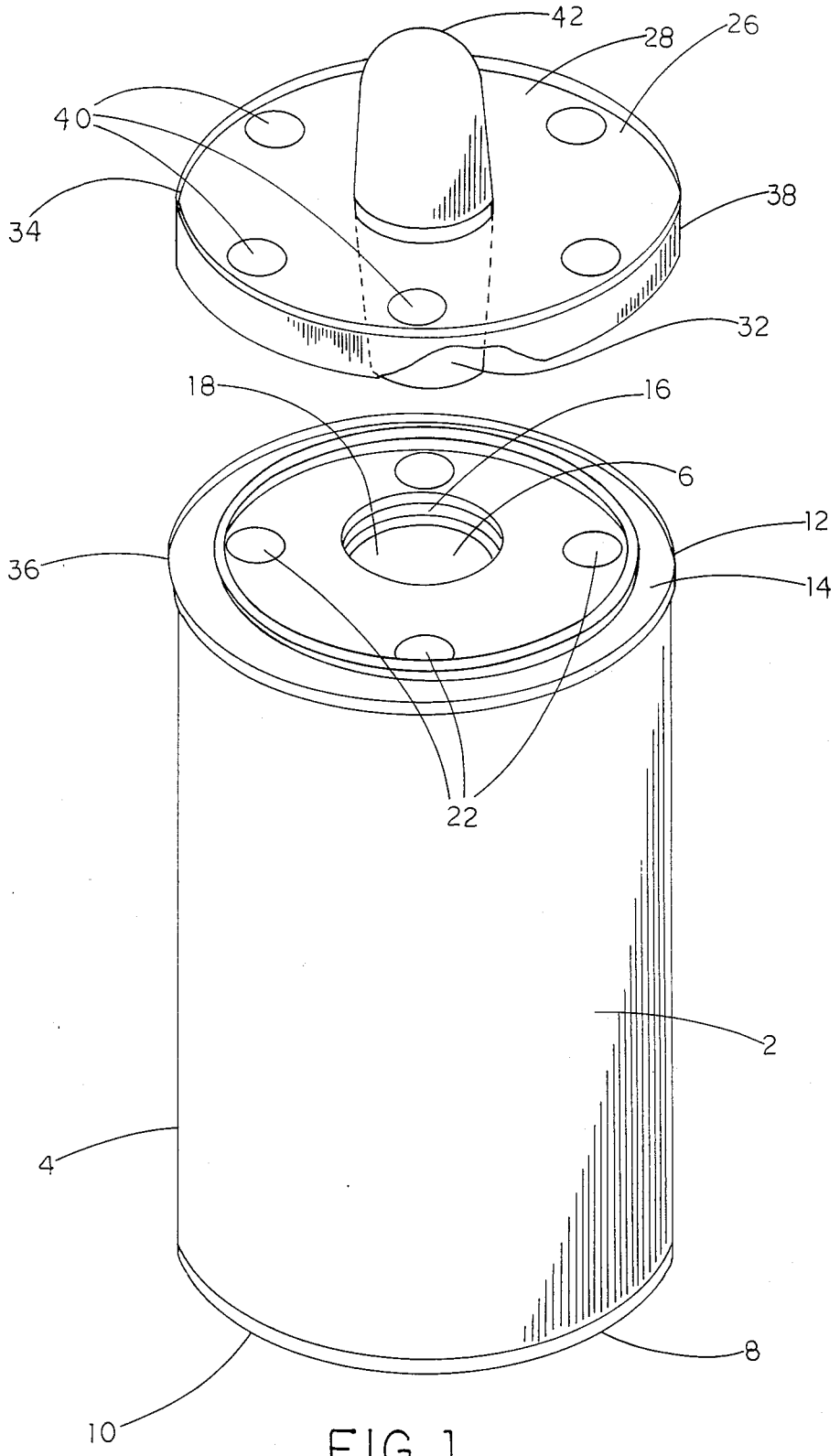
FIG. 1 is a perspective view of diesel fuel filter and a protective cap in accordance with this invention positioned above the open working end of the filter, with the central plug of the cap in registration with the opening to the central cavity of the filter.
Figure 2:
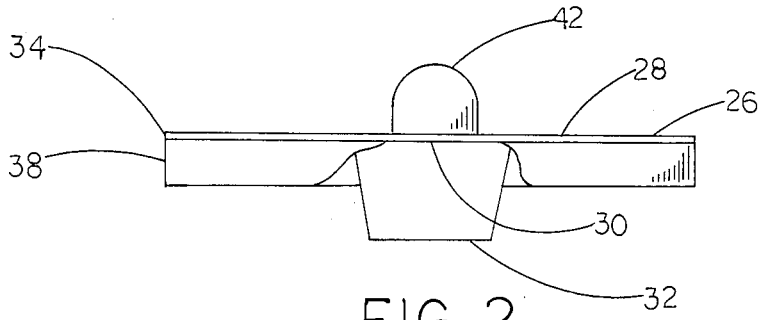
FIG. 2 is a side elevation view of the protective cap in accordance with this invention showing the depending sealing flange partly broken away.
Figure 3:
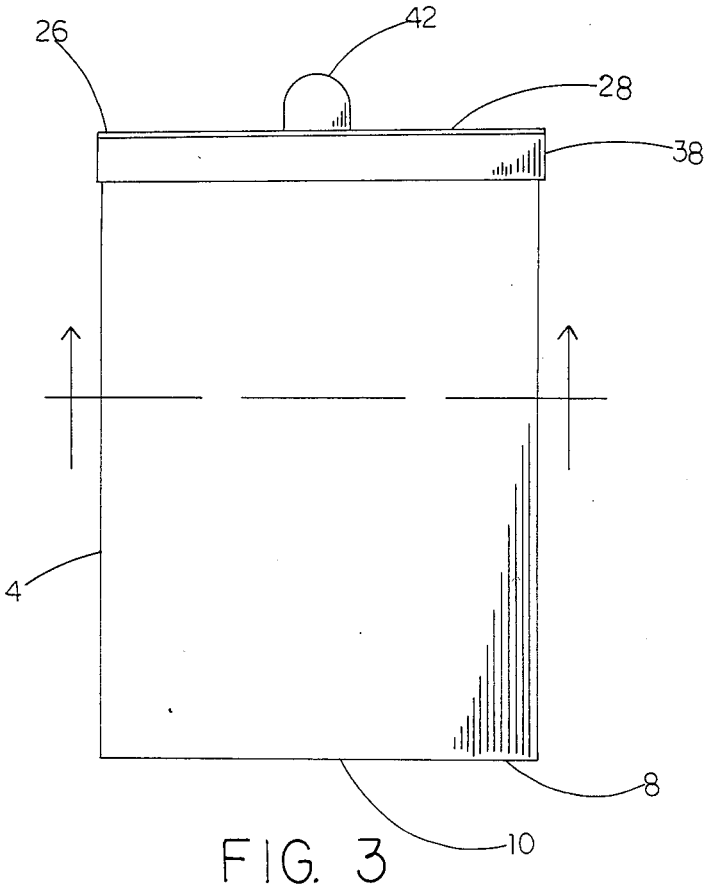
FIG. 3 is a side elevation view of the diesel fuel filter with the protective cap seated in place.
Figure 4:
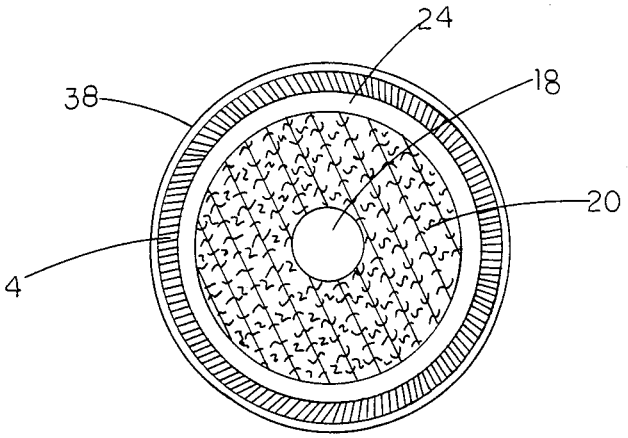
FIG. 4 is a section view taken on line 3—3 of FIG. 2.

A diesel fuel filter 2 includes a metal canister 4 having a cavity 6 therein, closed at the bottom end 8 by a peripheral wall 10 which bounds the sides and bottom of the cavity 6.

The canister 4 includes an open working end 12 partially covered by a canister disc 14 having a central aperture 16 opening to a central downstream cavity 18 on the downstream side of filtering material 20 and a plurality of circumferentially spaced apart peripheral apertures 22 opening to an annular upstream cavity 24 on the upstream side of the filtering material 20.

The peripheral apertures 22 are spaced apart radially from the central aperture 16.

The filtering material 20 is in the form of an annular body of permeable material through which diesel fuel may pass but which catches and filters out dirt and other contaminants as the fuel passes through the filtering material from the annular upstream cavity 24 to the central downstream cavity 18 from which the filtered fuel then flows to the diesel fuel pump when the filter is connected to the diesel engine. The annular body of filtering material 20 extends from the canister disc 14 at the working end 12 of the canister 4 to the bottom end 8 thereby forming a complete filter barrier between the upstream annular cavity 24 and the downstream central cavity 18.

The protective cap in accordance with this invention includes a cap disc 26 corresponding in size and configuration to the canister disc 14, having an upper substantially planar surface 28 and a lower substantially planar surface 30. A central plug 32 extends downwardly from the lower surface 30 of the cap disc 26 and centrally located thereon. The central plug 32 corresponds in cross-sectional dimension and configuration to that of the central aperture 16 of canister disc 14 which opens to the central downstream cavity 18 of the filter 2. The plug 32 may be of rubber or other compressible sealing material to seal the opening 16 from entry of diesel fuel therethrough when the plug 32 is seated therein.

When plug 32 is fully seated in the central aperture 16 of cannister disc 14, the cap disc 26 is adjacent to canister disc 14 in full facing relationship therewith. The outer annular rim 34 of cap disc 26 is in substantial registration with the annular rim 36 of the canister disc 14 when the central plug 32 is seated in the central aperture 16 of canister disc 14. A depending annular flange 38 of rubber or other sealing compressible material is provided around the rim 34 of the cap disc 26 to sealingly grip the upper annular edge of annular rim 36 of the canister disc 14.

At such time the peripheral apertures 40 of the cap disc 26 which extend in circumferentially spaced apart relationship around the outer portion of cap disc 26 are in communication with the peripheral apertures 22 of the canister disc 14 for passage of diesel fuel through the peripheral apertures 40 of cap disc 26 into and through the perpheral apertures 22 of canister disc 14, and thence into the annular upstream cavity 24 of the filter canister 4. The central plug 32 of cap disc 26 seated in central aperture 16 of canister disc 14 prevents any of the diesel fuel from entering into the central downstream cavity 18.

A hand grasp member 42 is provided in the center of the cap disc 26 for the mechanic to grasp for removal of the cap disc 26 from the canister 4 after the canister has been filled with diesel fuel and fully primed, ready to be mounted in place on the diesel engine.

I claim:

1. A protective cap for a diesel fuel filter, wherein said diesel fuel filter comprises a canister having a cavity, an open working end opening to said cavity, an annular body of filtering material positioned in said cavity surrounding a central downstream cavity, wherein said protective cap includes a cap disc having an upper surface and a lower surface, a sealing plug projecting from said lower surface having a cross-sectional dimension and configuration corresponding to that of the opening to said central downstream cavity to seal said downstream cavity from entry of diesel fuel therein when said sealing plug is seated in the said opening thereto, said cap disc overlying said working end of said canister and adjacent thereto when said sealing plug is seated in said opening to said central downstream cavity, said cap disc including cap disc aperture means positioned thereon to admit diesel fuel through said cap disc aperture means and into said canister at a location which is upstream from at least a portion of said filtering material, whereby diesel fuel passing through said cap disc aperture means must pass through at least a portion of said filtering material before filtering through into said central downstream cavity.

2. A protective cap for a diesel fuel filter as set forth in claim 1, wherein said diesel fuel filter includes a canister disc over said working end of said canister, said canister disc including a central aperture opening to said central downstream cavity, canister disc aperture means positioned thereon to admit diesel fuel through said canister disc aperture means and into said canister at a location which is upstream from at least a portion of said filtering material, whereby diesel fuel passing through said canister disc aperture means must pass through at least a portion of said filtering material before filtering through into said central downstream cavity, said central aperture of said canister disc having a cross-sectional dimension and configuration corresponding to that of said sealing plug of said cap disc for sealing of said central aperture of said canister disc against entry of diesel fuel therethrough into said central downstream cavity when said sealing plug is seated therein, said cap disc aperture means at such time being in communication with said canister disc aperture means for flow of diesel fuel through both.

3. A protective cap for a diesel fuel filter as set forth in claim 1, wherein said cap disc includes a hand grasp member projecting from said upper surface thereof.

4. A protective cap for a diesel fuel filter as set forth in claim 1, wherein said cap disc includes an annular rim, said open working end of said canister includes an annular rim corresponding in dimension and configuration to the annular rim of said cap disc, said cap disc including a depending annular flange of compressible sealing material to sealingly receive the upper portion of said canister around said annular rim of its said open working end when said sealing plug is seated in said opening to said downstream central cavity.

5. A protective cap for a diesel fuel filter as set forth in claim 2, wherein said cap disc aperture means includes a plurality of circumferentially spaced apart holes located radially outwardly from the center thereof.

6. A protective cap for a diesel fuel filter as set forth in claim 5, wherein said canister disc aperture means includes a plurality of circumferentially spaced apart holes located radially outwardly from central aperture thereof.

7. A protective cap for a diesel fuel filter as set forth in claim 6, wherein said annular body of filtering material comprises an annular ring located in said canister between an outer annular cavity on the upstream side of said filtering material and said central downstream cavity on the downstream side of said filtering material.

8. A protective cap for a diesel fuel filter as set forth in claim 7, wherein said circumferentially spaced apart holes of said cap disc and canister disc aperture means are in communication with said outer annular cavity for flow of diesel fuel therethrough and into said outer annular cavity on the upstream side of said filtering material, when said cap disc is in place over said canister disc.

* * * * *